US006681788B2

(12) United States Patent
Parce et al.

(10) Patent No.: US 6,681,788 B2
(45) Date of Patent: Jan. 27, 2004

(54) NON-MECHANICAL VALVES FOR FLUIDIC SYSTEMS

(75) Inventors: J. Wallace Parce, Palo Alto, CA (US); Andrea W. Chow, Los Altos, CA (US)

(73) Assignee: Caliper Technologies Corp., Hopkinton, MA (US)

( * ) Notice: Subject to any disclaimer, the term of this patent is extended or adjusted under 35 U.S.C. 154(b) by 2 days.

(21) Appl. No.: 10/056,219

(22) Filed: Jan. 24, 2002

(65) Prior Publication Data

US 2002/0153047 A1 Oct. 24, 2002

Related U.S. Application Data

(60) Provisional application No. 60/264,788, filed on Jan. 29, 2001.

(51) Int. Cl.[7] ..... F15C 1/18

(52) U.S. Cl. ..... 137/14; 137/806; 137/818; 137/825; 137/827; 204/601

(58) Field of Search ..... 137/806, 825, 137/827, 818, 14; 204/601

(56) References Cited

U.S. PATENT DOCUMENTS

| | | | | |
|---|---|---|---|---|
| 4,390,403 A | | 6/1983 | Batchelder | |
| 4,459,267 A | | 7/1984 | Bunce et al. | |
| 4,908,112 A | * | 3/1990 | Pace | 356/318 |
| 5,126,022 A | * | 6/1992 | Soane et al. | 204/458 |
| 5,296,114 A | * | 3/1994 | Manz | 204/451 |
| 5,304,487 A | | 4/1994 | Wilding et al. | |
| 5,498,392 A | | 3/1996 | Wilding et al. | |
| 5,571,410 A | | 11/1996 | Swedberg et al. | |
| 5,573,651 A | | 11/1996 | Dasgupta et al. | |
| 5,585,069 A | | 12/1996 | Zanzucchi et al. | |
| 5,593,838 A | | 1/1997 | Zanzucchi et al. | |
| 5,599,432 A | * | 2/1997 | Manz et al. | 204/451 |
| 5,603,351 A | | 2/1997 | Cherukuri et al. | |
| 5,635,358 A | | 6/1997 | Wilding et al. | |
| 5,637,469 A | | 6/1997 | Wilding et al. | |
| 5,699,157 A | | 12/1997 | Parce | |
| 5,716,852 A | | 2/1998 | Yager et al. | |
| 5,750,015 A | | 5/1998 | Soane et al. | |
| 5,800,690 A | * | 9/1998 | Chow et al. | 204/451 |
| 5,858,187 A | | 1/1999 | Ramsey et al. | |
| 5,858,195 A | | 1/1999 | Ramsey | |
| 5,869,004 A | | 2/1999 | Parce et al. | |
| 5,876,675 A | | 3/1999 | Kennedy | |
| 5,880,071 A | | 3/1999 | Parce et al. | |
| 5,882,465 A | | 3/1999 | McReynolds | |

(List continued on next page.)

FOREIGN PATENT DOCUMENTS

| | | |
|---|---|---|
| WO | WO 9405414 | 3/1994 |
| WO | WO 9604547 | 2/1996 |

(List continued on next page.)

OTHER PUBLICATIONS

Chien, R–L et al., "Multiport Flow–Control System for Lab–on–a–Chip Microfluidic Devices," *Anal Chem.* (2001) 371:106–111.

Dasgupta, P.K. et al., "Electroosmosis: A Reliable Fluid Propulsion System for Flow Injection Analysis," *Anal. Chem.* (1994) 66:1792–1798.

(List continued on next page.)

*Primary Examiner*—A. Michael Chambers
(74) *Attorney, Agent, or Firm*—Matthew B. Murphy; Andrew L. Filler

(57) ABSTRACT

Methods devices and systems that employ non-mechanical valve modules for controllably directing fluid and other material movement through integrated microscale channel networks. These non-mechanical valve modules apply forces that counter the driving forces existing through a given channel segment, via fluidly connected channel segments, so as to selectively arrest flow of material within the given channel segment.

34 Claims, 6 Drawing Sheets

U.S. PATENT DOCUMENTS

| | | | | | |
|---|---|---|---|---|---|
| 5,885,470 | A | | 3/1999 | Parce et al. | |
| 5,932,100 | A | | 8/1999 | Yager et al. | |
| 5,942,443 | A | | 8/1999 | Parce et al. | |
| 5,948,227 | A | | 9/1999 | Dubrow | |
| 5,955,028 | A | | 9/1999 | Chow | |
| 5,958,694 | A | | 9/1999 | Nikiforov | |
| 5,959,291 | A | | 9/1999 | Jensen | |
| 5,965,001 | A | | 10/1999 | Chow et al. | |
| 5,965,410 | A | | 10/1999 | Chow et al. | |
| 5,976,336 | A | | 11/1999 | Dubrow et al. | |
| 5,979,868 | A | | 11/1999 | Wu et al. | |
| 5,989,402 | A | | 11/1999 | Chow et al. | |
| 6,001,229 | A | | 12/1999 | Ramsey | |
| 6,001,231 | A | | 12/1999 | Kopf-Sill | |
| 6,010,607 | A | | 1/2000 | Ramsey | |
| 6,010,608 | A | | 1/2000 | Ramsey | |
| 6,012,902 | A | | 1/2000 | Parce | |
| 6,033,546 | A | | 3/2000 | Ramsey | |
| 6,039,211 | A | | 3/2000 | Slater et al. | |
| 6,042,709 | A | | 3/2000 | Parce et al. | |
| 6,046,056 | A | | 4/2000 | Parce et al. | |
| 6,062,261 | A | * | 5/2000 | Jacobson et al. | 137/827 |
| 6,074,725 | A | | 6/2000 | Kennedy | |
| 6,100,541 | A | | 8/2000 | Nagle et al. | |
| 6,120,666 | A | | 9/2000 | Jacobson et al. | |
| 6,149,787 | A | | 11/2000 | Chow et al. | |
| 6,156,181 | A | | 12/2000 | Parce et al. | |
| 6,213,151 | B1 | * | 4/2001 | Jacobson et al. | 137/827 |
| 6,221,226 | B1 | | 4/2001 | Kopf-Sill | |
| 6,231,737 | B1 | | 5/2001 | Ramsey et al. | |
| 6,235,175 | B1 | | 5/2001 | Dubrow et al. | |
| 6,235,471 | B1 | | 5/2001 | Knapp et al. | |
| 6,280,589 | B1 | | 8/2001 | Manz et al. | |
| 6,342,142 | B1 | | 1/2002 | Ramsey | |

FOREIGN PATENT DOCUMENTS

| | | |
|---|---|---|
| WO | WO 9702357 | 1/1997 |
| WO | WO 0045172 | 8/2000 |
| WO | WO 0163270 | 8/2001 |

OTHER PUBLICATIONS

Effenhauser, C.S. et al., "Glass Chips for High–Speed Capillary Electrophoresis Separations with Submicrometer Plate Heights," *Anal. Chem.* (1993) 65: 2637–2642.

Effenhauser, C.S. et al., "High Speed Separation of Antisense Oligonucleotides on a Micromachined Capillary Electrophoresis Device," *Anal. Chem.* (1994) 66: 2949–2953.

Effenhauser, C.S. et al., "Integrated Capillary Electrophoresis on Flexible Silicone Microdevices: Analysis of DNA Restriction Fragments and Detection of Single DNA Molecules on Microchips," *Anal. Chem.* (1997) 69: 3451–3457.

Fan, Z.H. et al., "Micromachining of Capillary Electrophoresis Injectors and Separators on Glass Chips and Evaluation of Flow of Capillary Intersections," *Anal. Chem.* (1994) 66: 177–184.

Fister, J.C. III et al., "Counting Single Chromophore Molecles for Ultrasensitive Analysis and Separations on Microchip Devices," *Anal. Chem.* (1998) 70: 431–437.

Hadd, A.G. et al., "Microfluidic Assays of Acetylcholinesterase," *Anal. Chem.* (1999) 71: 5206–5212.

Harrison, J. et al., "Capillary Electrophoresis and Sample Injection Systems Integrated on a Planar Glass Chip," *Anal. Chem.* (1992) 64: 1926–1932.

Harrison, J. et al., "Towards Miniaturized Electrophoresis and Chemical Analysis Systems on Silicon: An Alternative to Chemical Sensors*," *Sensors and Actuators B* (1993) 10: 107–116.

Harrison, J. et al., "Micromachining a Miniaturized Capillary Electrophoresis–Based Chemical Analysis System on a Chip," *Science* (1993) 261: 895–897.

Harrison, D.J. et al., "Integrated Electrophoresis Systems for Biochemical Analyses," *Solid–State Sensor and Actuator Workshop* (1994) 21–24.

Jacobson, S.C. et al., "Effects of Injection Schemes and Column Geometry on the Performance of Microchip Electrophoresis Devices," *Anal. Chem.* (1994) 66:1107–1113.

Jacobson, S.C. et al., "High–Speed Separations on a Microchip," *Anal. Chem.* (1994) 66: 1114–1118.

Jacobson, S.C. et al., "Open Channel Electrochromatography on a Microchip," *Anal. Chem.* (1994) 66: 2639–2373.

Jacobson, S.C. et al., "Precolumn Reactions with Electrophoretic Analysis Integrated on a Microchip," *Anal. Chem.* (1994) 66: 4127–4132.

Jacobson, S.C. et al., "Microchip Electrophoresis with Sample Stacking," *Electrophoresis* (1995) 16: 481–486.

Jacobson, S.C. et al. ,"Fused Quartz Substrates for Microchip Electrophoresis," *Anal. Chem.* (1995) 67: 2059–2063.

Jacobson, S.C. et al., "Integrated Microdevice for DNA Restriction Fragment Analysis," *Anal. Chem.* (1996) 68: 720–723.

Jacobson, S.C. et al., "Electrokinetic Focusing in Microfabricated Channel Structures," *Anal. Chem.* (1997) 69: 3212–3217.

Jacobson, S.C. et al., "Microfluidic Devices for Electrokinetically Driven Parallel and Serial Mixing," *Anal. Chem.* (1999) 71: 4455–4459.

Manz, A. et al., "Miniaturized Total Chemical Analysis Systems: a Novel Concept for Chemical Sensing," *Sensors and Actuators* (1990) B1: 244–248.

Manz, A. et al., "Micromachining of Monocrystalline Silicon and Glass for Chemical Analysis Systems," *Trends in Analytical Chemistry* (1991) 10:144–149.

Manz, A. et al., "Planar Chips Technology for Miniaturization and Integration of Separation Techniques into Monitoring Systems," *Journal of Chromatography* (1992) 593:253–258.

Manz, A. et al., "Planar Chips Technology for Miniaturization of Separation Systems: A Developing Perspective in Chemical Monitoring."

Manz, A. et al., "Electroosmotic Pumping and Electrophoretic Separations for Miniaturized Chemical Analysis Systems," *J. Micromach. Microeng.* (1994) 4: 257–265.

Manz, A. et al., "Parallel Capillaries for High Throughput in Electrophoretic Separations and Electroosmotic Drug Discovery Systems," International Conference on Solid–State Sensors and Actuators (1997) 915–918.

McCormick, R.M. et al., "Microchannel Separations of DNA in Injection–Molded Plastic Substrates," *Anal. Chem.* (1997) 69: 2626–2630.

Moore, A.W. et al., "Microchip Separations of Neutral Species via Micellar Electrokinetic Capillary Chromatography," *Anal. Chem.* (1995) 67: 4184–4189.

Ramsey, J.M. et al., "Microfabricated Chemical Measurement Systems," *Nature Medicine* (1995) 1:1093–1096.

Salimi–Moosavi, H. et al., "Biology Lab–on–a–Chip for Drug Screening," Solid–State Sensor and Actuator Workshop (1998) 350–353.

Sandoval, J.E. et al., "Method for the Accelerated Measurement of Electroosmosis in Chemically Modified Tubes for Capillary Electrophoresis," *Anal. Chem.* (1996) 68:2771–2775.

Seiler, K. et al., "Planar Glass Chips for Capillary Electrophoresis: Repetitive Sample Injection, Quantitation, and Separation Efficiency," *Anal. Chem.* (1993) 65:1481–1488.

Seiler, K. et al., "Electroosmotic Pumping and Valveless Control of Fluid Flow within a Manifold of Capillaries on a Glass Chip," *Anal. Chem.* (1994) 66:3485–3491.

Ueda, M. et al., "Imaging of a Band for DNA Fragment Migrating in Microchannel on Integrated Microchip," *Materials Science and Engineering C* (2000) 12:33–36.

Wang, C. et al., "Integration of Immobilized Trypsin Bead Beds for Protein Degestion within a Microfluidic Chip Incorporating Capillary Electrophoresis Separations and an Electrospray Mass Spectrometry Interface," *Rapid Commin. Mass Spectrom.* (2000) 14:1377–1383.

Woolley, A.T. et al., "Ultra–High–Speed DNA Fragment Separations Using Microfabricated Capillary Array Electrophoresis Chips," *Proc. Natl. Acad. Sci. USA* (1994) 91:11348–11352.

Woolley, A.T. et al., "Functional Integration of PCR Amplification and Capillary Electrophoresis in a Microfabricated DNA Analysis Device," Anal. Chem. (1996) 68: 4081–4086.

Woolley, A.T. et al., "High–Speed DNA Genotyping Using Microfabricated Capillary Array Electrophoresis Chips," *Anal. Chem.* (1997) 69:2181–2186.

Woolley, A.T. et al., "Capillary Electrophoresis Chips with Integrated Electrochemical Detection," *Anal. Chem.* (1998) 70: 684–688.

Zhang, B. et al., "Microfabricated Devices for Capillary Electrophoresis–Electrospray Mass Spectrometry," *Anal. Chem.* (1999) 71:3258–3264.

* cited by examiner

NON-MECHANICAL VALVES FOR FLUIDIC SYSTEMS

CROSS-REFERENCE TO RELATED APPLICATIONS

This application claims priority to Provisional Patent Application No. 60/264,788, filed Jan. 29, 2001, which is hereby incorporated herein in its entirety for all purposes.

BACKGROUND OF THE INVENTION

Microfluidic devices, systems and methods have been gaining acceptance as potentially providing a quantum leap forward in analytical chemical and biochemical processes. In particular, these systems have generally offered the promise of miniaturization, integration and automation to processes that have previously been performed using techniques that have not substantially changed in decades.

To a large extent, the advance of microfluidic technology has been due, at least in part, to the microfabrication technologies as used in the electronics industry, that are used to fabricate intricate networks of microscale channels and chambers in solid substrates. The field has also benefited substantially from development of methods, devices and systems for precisely controlling the movement and direction of fluids, and other materials within these channel networks.

Early researchers focused efforts on minimizing control elements from the microscale world, e.g., valves, pumps, etc. While these developments were interesting from a technical standpoint, they presented numerous additional problems associated with the cost and complexity of manufacturing those elements.

In the mid 90s, integrated electrokinetic control of fluid or other material movement was developed, which gave rise to the "virtual valve" concept. In brief, through the controlled application of electric fields, one could precisely control the movement of fluids or other materials through interconnected channel structures. These methods generally relied upon the convergence of electric fields at an intersecting point to dictate which components would flow into the intersection, and what the relative quantities of those components would be.

While these pioneering developments were fundamental to the inception of the microfluidics industry, the first commercial versions of these systems typically required flowing materials in each of the various channels that were communicating at common intersection points or channel regions. In a number of particular applications, it would be generally desirable to more definitively control material flow in interconnected channels. For examples, in some cases, it would be desirable to entirely arrest the flow of material along a particular channel, while allowing continued flow in another cannel that is in communication with the first. Further, it would be desirable to obtain these control aspects, without having to include complex structures, such as mechanical valves, pumps, or the like. The present invention meets these and a variety of other important needs.

SUMMARY OF THE INVENTION

The present invention is generally directed to methods, devices and systems that utilize non-mechanical valves for use in microfluidic channel systems. Thus, in at least a first aspect, the invention provides a method of controlling material flow in a microscale channel. In accordance with this method, a first channel segment is provided that has first and second ends. A second channel segment is also provided communicating with the first channel segment at a first fluid junction, the first fluid junction being disposed between the first and second ends of the first channel segment. A third channel segment is additionally provided communicating with the first channel segment at a second fluid junction, the second fluid junction being disposed between the first fluid junction and the second end of the first channel segment. A differential driving force is applied between the first and second ends of the first channel segment. In addition, a second differential driving force is applied through the second channel segment that is sufficient to substantially eliminate a differential driving force between the first end of the first channel segment and the first fluid junction, while a third differential driving force is selectively applied through the third channel segment sufficient to substantially eliminate a differential driving force between the second fluid junction and the second end of the first channel segment.

In a related aspect, valve modules are provided, e.g., in microfluidic devices and systems, that include, for example, the channel elements set forth above, in combination with a flow controller that is coupled to at least one end of the first channel and also coupled to the second and third channels. The flow controller is set to apply the first, second and third driving forces set forth above to operate the valve module.

DETAILED DESCRIPTION OF THE INVENTION

The present invention is generally directed to microfluidic structures, and particularly, channel structures that include an integrated valve module. As used herein, the phrase "valve module" refers to a series of interconnected channels that, when operated in an appropriate manner, functions to arrest flow of fluids or other materials in at least one of the interconnected channels in the network. The valve modules employed in the methods and systems of the present invention employ no mechanical or moving parts within the channel structure, and operate primarily by presenting a force at an end of a channel segment that is sufficient to block flow within that channel segment, without erecting a physical structure barrier to that flow.

In general, the valve module includes a main channel segment that is in fluid communication with at least two other channel segments to make up the valve module. As used herein, a channel segment means an enclosed fluidic conduit or channel, and may encompass an entire length of a channel, e.g., spanning from one terminus (e.g., intersected or unintersected terminus, i.e., a dead-end or terminus at a port or reservoir) to the other, or it may be any portion or subset of the overall length of the entire channel.

Figure 1A:
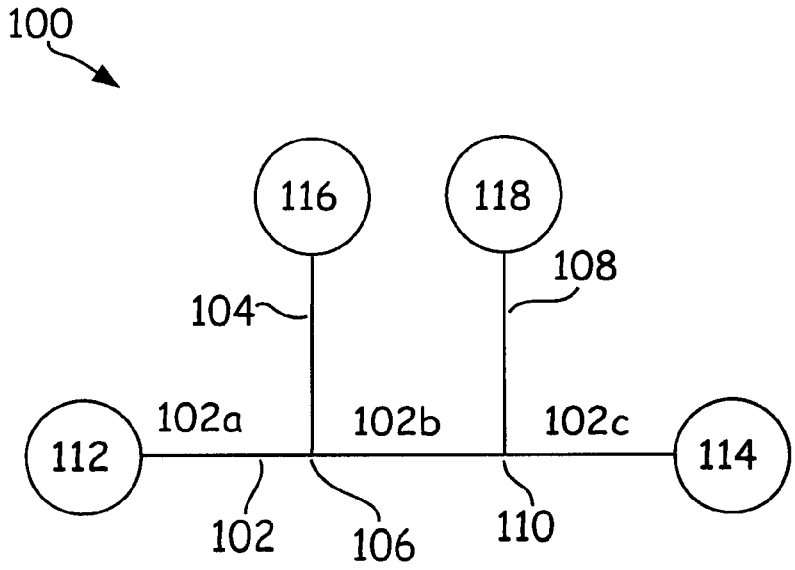
FIG. 1A schematically illustrates the channel layout while FIG. 1B enumerates the various driving force differentials present within that channel layout.

A simplified schematic of the valve module 100 is illustrated in FIG. 1A. As shown, the main channel segment 102 is intersected by a first channel segment 104 at a first fluid junction 106 and a second channel segment 108 that intersects main channel segment 102 at fluid junction 110. For ease of illustration, the various channel segments in valve module 100 are shown connecting various reservoirs, although as noted previously and in many preferred aspects, these channel segments terminate at intersections with other channels in an overall system in which a valve module is desired. As shown, main channel segment 102 spans between reservoirs 112 and 114, while channel segment 104 connects reservoir 116 to fluid junction 106 at channel segment 102. Similarly, channel segment 108 connects reservoir 118 with fluid junction 110 at channel segment 102. The two fluid junctions divide channel segment 102 into three sub-segments 102*a*, 102*b* and 102*c*.

In operation, the valve module operates to selectively arrest overall flow of material along the length of channel segment 102, e.g., between reservoirs 112 and 114, and particularly from reservoir 112, and toward reservoir 114. As used herein, the term material typically denotes fluids, ions, macromolecules, cells, particles (beads, viruses, etc), or the like, provided that material is of a size sufficient to fit within the channel segments. The materials may be disposed within fluids, gels, fluidic polymer solutions, or any other medium capable of permitting movement of the material, either through the medium or as a component during bulk movement of the medium.

Figure 1B:
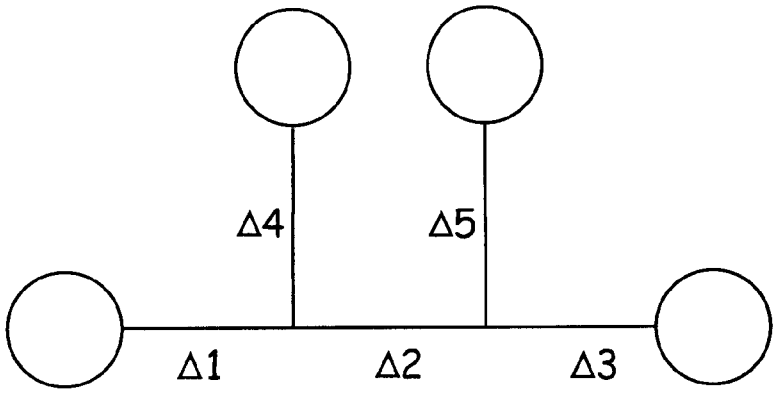
FIG. 1 is a schematic illustration of a simple valve module in accordance with the present invention.

Flow along the main channel segment 102 is generated by applying a differential driving force along the channel segment 102. Differential driving forces are typically any force that will cause movement of the material along the channel segment and include pressure differentials, electrokinetic differentials, or the like. A general circuit diagram can be generated for the valve module in FIG. 1A and is shown in FIG. 1B with the various force differential indicated adjacent each channel segment or sub-segment. As shown, the main channel includes three different driving force differentials labeled Δ1, Δ2, and Δ3. Force differentials applied through each of channel segments 104 and 108 are indicated by Δ4 and Δ5, respectively. In the operation of the valve modules of the present invention, a differential driving force is applied through main channel segment to cause movement of material from one end, e.g., reservoir 112, toward the other end, e.g., reservoir 114. As shown in FIG. 1B, the differential driving force is the sum of Δ1, Δ2, and Δ3 (or for the entire channel segment, $\Delta_{Total}$). In the open mode, e.g., where fluid or other material is flowing along the length of channel segment 102, there is substantially no differential force applied through channels 104 and 108. Phrased differently, Δ4 and Δ5 each substantially equal zero. In the closed mode, e.g., where flow through channel segment 102 is to be arrested, the differential forces applied through channels 104 and 108 are changed. In particular, the differential through channel segment 104, e.g., Δ4, is changed so as to eliminate the differential driving force across segment 102*a*, e.g., Δ1 is brought to approximately zero. In the case of pressure based flow, this is done by applying a pressure differential through channel 104 that yields a pressure at the first fluid junction 106 that is equal to the pressure at reservoir 112, and thus, the difference between the two is zero. This will have the effect of arresting flow within channel segment 102*a*, e.g., flow into the valve module, but will not arrest flow through channel segment 102*c*.

In order to arrest flow into and out of the valve module, a driving force differential is applied through channel segment 108 that results in the driving force differential across channel segment 102*c*, e.g., Δ3, being brought to substantially zero. As described with the inlet side of the valve, e.g., fluid junction 106, in a pressure based flow format above, the control of flow through the outlet side of the valve, e.g., fluid junction 110, is accomplished by changing the pressure at the second fluid junction 110 to match the pressure at reservoir 114. As can be readily appreciated, while a pressure differential still exists between reservoirs 112 and 114, that entire differential is effectively tapped off into channels 104 and 108. That is, the entire pressure differential exists between fluid junction 106 and fluid junction 110.

Although not a preferred method of operation, it will be readily appreciated that the valve modules, in certain circumstances, may include only a subset of the channels shown in FIG. 1. For example, where it is only necessary to stop flow from reservoir 112, without regard to the efflux through channel segment 102*c*, one can operate to stop that flow by applying sufficient pressure through channel 104 to reduce Δ1 to zero, without applying any pressures to eliminate Δ3. While this will arrest flow through segment 102*a*, it will not stop the flow through channel 102*c*, replacing the flow from reservoir 112 with flow from reservoir 116.

In order to apply the requisite driving forces to the various channels, in order to open and close the valve modules, the systems of the invention include a flow controller that is operably coupled to the various channels through which the driving force is to be applied. As noted herein, as the driving force can vary depending upon the application, so too can the flow controller. For example, electrokinetically driven systems typically employ electrokinetic flow controllers, while pressure driven systems employ pressure controllers.

In turn, the operable connection between the flow controller and the various channels will depend upon the nature of the flow controller. For example, operable connection between an electrokinetic flow controller and a channel typically involves the use of an electrical connection between an electrical power supply within the controller and an appropriate access point to the channel in question. In general, such connections involve electrodes that are disposed in electrical contact with fluid that is in or fluidly coupled to the channel, e.g., in a reservoir at a channel terminus, such that an electric field can be applied through the channel in question, or an associated channel whereby an appropriate driving force may be created through the channel in question.

In pressure based systems, operable connection typically includes a sealed conduit between a pressure and/or vacuum pump within the controller, and a terminus of the channel or channels in question. A variety of sealing connections, e.g., using o-rings, press fittings, or the like, can be readily produced for coupling a pressure or vacuum line to a reservoir in a microfluidic device.

In addition to the source of the driving force, e.g., an electrical power supply or a pressure or vacuum source, the controllers also typically include, or are operably coupled to a processor that permits the programming or "setting" of the controller for operation of the various valve modules of the device. In particular, and with reference to FIGS. 1A and 1B, the processor may include appropriate programming to instruct the various pressure sources within the controller to delivered selected pressures to, e.g., reservoir 112, 116, 118, and optionally 114, so as to arrest flow of material from reservoir 112 to reservoir 114. As noted, this involves applying sufficient pressure or vacuum to reservoirs 116 and 118 to reduce $\Delta 1$ and $\Delta 3$, respectively, to approximately zero, based upon the pressure differential that exists between reservoir 112 and 114. As noted, such programming may be based upon a feedback indicator within the system, e.g., that indicates when flow is arrested in each of channel portions 102*a* and 102*c*. Alternatively, the programming applies appropriate pressure or vacuum that was predetermined to be the appropriate level, either based upon empirical testing or calculated fluidic properties of the fluid/channel system that is being used, e.g., based upon the cross-sectional area and length of the channel segments as well as the viscosity of the fluid. The processor may be internal to the flow controller or it may be embodied in a separate computer, e.g., a PC running a Pentium, Pentium II, Pentium Pro or Celeron processor.

Figure 3:
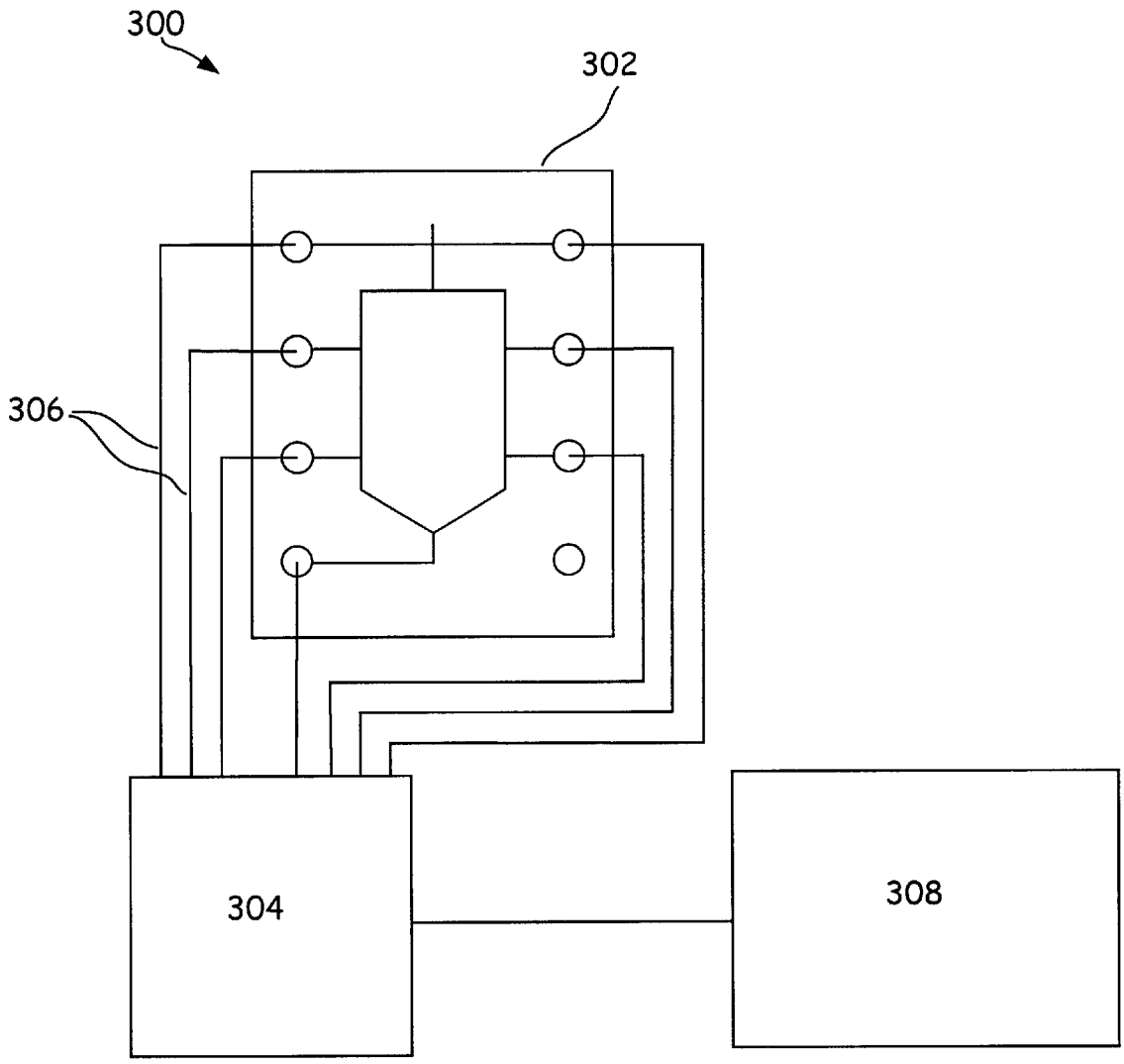
FIG. 3 is a schematic illustration of an overall system in accordance with the present invention.

An exemplary system structure is schematically illustrated in FIG. 3. As shown, the overall system 300 includes a microfluidic device 302 that incorporates the valve module (s) of the invention. A flow controller 304 is operably coupled to the various channels of the device, e.g., through control lines 306 (e.g., electrical connections or vacuum/pressure lines). A processor 308 is also typically coupled to or integral with the controller to instruct the appropriate delivery of driving forces to the various channels of the device to ensure proper operation.

One of the advantageous uses of the valve modules of the present invention is in systems that include multiple interconnected parallel processing channel systems. Specifically, the valve modules are particularly useful where one would like to arrest flow in one channel network while permitting continued flow in a fluidly connected second channel network. Such systems are useful where long term storage, incubation, or the like is desired for materials being moved through certain of the microfluidic channels in a more complex network of channels. One of the advantages of such a system is that it reduces the amount of material dispersion that would result from long term movement of material plugs or volumes through a channel system. In particular, while one could extend the amount of time a material is kept in one channel network, e.g., to prolong incubation, reaction or the like, by simply providing an extended length channel system, the dispersion of moving materials within such channels would substantially reduce the efficiency of transporting discrete slugs of material in those systems, as dispersion is related, at least in part, to the movement of the material through the channel network. As such, it is useful to be able to arrest flow, and thereby reduce the amount of dispersion that the material is subjected to when prolonged incubation and/or reaction is desired.

Figure 2:
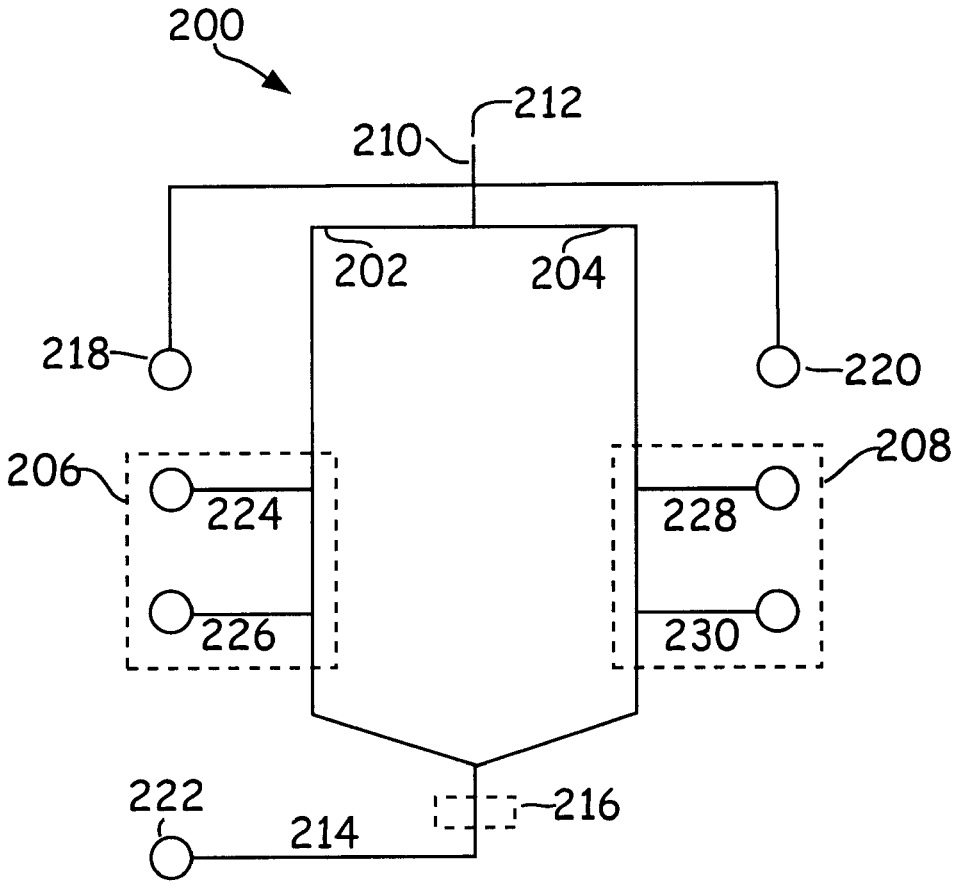
FIG. 2 is a schematic illustration of a multiplexed microfluidic device that includes the valve modules of the present invention in conjunction with a high-throughput sampling and analysis functionalities in the device.

An example of a multiplexed channel system 200, e.g., with two interconnected analytical channel systems incorporating valve modules is illustrated in FIG. 2. As shown, two channel networks 202 and 204 each include a separate valve module 206 and 208, respectively. Each of the channel networks 202 and 204 are in communication at an inlet channel segment 210, as well as in a detection channel segment 214, e.g., that includes a detection zone 216.

In preferred embodiments, at the inlet end of the overall system 200 is provided, e.g., a capillary sampling element (not shown), for bringing test materials into the overall system. The inlet from the capillary element to the channel network is illustrated as inlet 212. Other sources of the material to be transported through the channel networks may optionally or additionally provided, e.g., as reservoirs fluidly coupled to the inlet end of the overall system, e.g., reservoirs 218 and 220. For example, where each of the channel networks is intended to perform a particular enzyme assay on different test compounds, the enzyme and substrate used in the assay reaction is optionally provided in one or more reservoirs that are fluidly coupled to the inlet channel segment 210. As test materials are brought into the system, they are mixed with the enzyme and substrate mixture.

These multiplexed systems are particularly useful in the context of high-throughput analytical operations, e.g., high-throughput pharmaceutical screening, high-throughput genetic analysis, and the like. In particular, multiple, e.g., from 2 to 100 or more, different analyses can be processed concurrently in different channel networks within the same device, allowing economies of reduced scale and increased speed to be accomplished. By way of example, high-throughput pharmaceutical screening operations are readily performed, e.g., as described in U.S. Pat. Nos. 5,942,443 and 6,046,056, each of which is hereby incorporated herein by reference in its entirety for all purposes.

These methods typically employ flowing components of a biochemical system that is the subject of the screen, e.g., a biological assay. Such components typically include enzymes, substrates, receptors, ligands, antibodies and antigens, whole cells, cell fractions, or any of a wide variety of other system components that are desired to be screened against. Within the flowing system, is a labeling function, e.g., a fluorogenic substrate for a given enzyme, a binding indicator label, or the like, that produces a steady state signal indicative of the normal level of activity of the provided biological system components.

When a test compound, e.g., a pharmaceutical candidate, is introduced into the flowing system, where that compound affects the biological activity, it will result in a deviation in the steady state signal of that system, and the compound can be identified as an effector of that system, e.g., an inhibitor.

In the context of the screening example, each of the different channel networks shown in FIG. 2 could have different biological system components flowing through the channels, which are then subjected to screening the same compounds, or they include the same biological system components and have different test compounds introduced into them.

Alternatively, each different channel system could be used to perform a same genetic analysis on a different target sample or nucleic acid sequence, e.g., amplification and genotyping or separation based analysis.

Although generally described in terms of drawing materials into a fluid conduit and incubating it there, the valve systems of the invention are also optionally used in selectively drawing in fluids and expelling fluids from fluid conduits, e.g., microscale fluidic devices. In particular, there are a number of applications that would benefit from first drawing material into a microscale channel containing device, performing some manipulation on that material, and then expelling that material into a separate instrument. For example, in certain applications, i.e., proteomics, one may wish to first separate macromolecules, followed by injection of those materials into a mass spec. In order to draw material into a chip typically requires a negative pressure differential between the sample well, which is typically at ambient pressure, and the channel into which the material is drawn. However, expulsion of material from a channel typically requires a positive pressure differential from the channels of the device to the ultimate destination of the material, again, which is often at or near ambient pressure. As such, there is generally a need to have both low and high pressure regions within an interconnected channel structure. While this could be done readily with mechanical valves, the complexity and expense of manufacturing such valves is often prohibitive. The non-mechanical valves described herein are particularly useful for segregating pressure effects among interconnected channels in a single channel network, and are therefore particularly suited to use in channel networks that include both input and output functions.

Regardless of the application for the particular device or system, the ability to separately and completely control flow of material within separate but interconnected channel structures is highly advantageous. In operation, the system illustrated in FIG. 2 functions as described with respect to the valve module illustrated in FIG. 1. For example, a set pressure differential is optionally applied between the inlet channel and the detection channel, e.g., by applying a vacuum to reservoir 222. When the overall system is not subjected to any control, e.g., all reservoirs and sampling elements are open to ambient pressure, this would result in flow from all reservoirs and the sampling element toward reservoir 222, which flow would vary among the various channels depending upon their resistance to such flow, e.g., as dictated by their cross-sectional areas, length, etc. However, while the valve modules are in the "open" or flowing mode, pressures, positive or negative, will be applied so as to eliminate pressure differentials along the valve module channels, e.g., channels 224 and 226, resulting in no net flow of material from these channels toward reservoir 222. Accordingly, the material flowing along each of channels 202 and 204, when the valve modules are open, will be made up of only the material flowing into those channels from the inlet channel, e.g., material coming from the sampling element and from reservoirs 218 and 220.

Each of the valve modules may then be independently operated to arrest the flow of any material through its associated channel network by switching the valve module to the closed configuration, e.g., as described with respect to FIG. 1. In closing valve module 206, flow of all material between the inlet channel 210 and the detection channel 214 through channel 202 is arrested, without affecting any of the material flow between the inlet channel 210 and the detection channel 214 through channel 204. In application, reaction materials such as biological system components, e.g., flowed from reservoirs 218 and 220 are flowed into one channel, e.g., channel 202, along with a test compound plug introduced from the sampling element via inlet 212. Flow into channel 202 is selected by leaving valve module 206 in an open configuration while putting valve module 208 in the closed configuration, forcing flow along channel 202. All of these reagents mix within the inlet channel 210 and reaction channel 202. Flow is then arrested within channel 202 by closing valve module 206 as described above, to allow the various components to incubate within that channel without the original test compound material being subjected to excessive dispersion. Arresting flow is done when the reaction materials of interest are within the reaction channel, e.g., channel 202, but not between the channels of the valve module, e.g., channels 224 and 226, as flow continues within channel 202, between those channels.

While the systems are readily employed to screen against premixed reagents, e.g., mixtures that are supplied into the channel from a premixed reagent well, e.g., via a sampling element, in preferred aspects, at least some reagents are provided in sources that are integrated into the overall channel network, e.g., reservoirs 218 and 220, and are thus mixed within the channel network.

While the first test compound is being incubated in channel 202, a second test compound is drawn into inlet channel 210 and mixed with reaction components from reservoirs 218 and 220 and directed through channel 204 by virtue of valve module 208 being in the open configuration and valve module 206 being in the closed configuration. Once the reagents are flowed into channel 204, then flow through that channel is arrested by closing valve module 206.

Once sufficient reaction or incubation time has passed, valve module 206 may be opened allowing the reaction mixture to flow into detection channel 214 and past detection window 216, where the results of the incubation/reaction are detected. This is then repeated for the second set of reaction components in channel 204 by closing valve module 206 and opening valve module 208. Although illustrated with two channels and valve modules, this multiplexing can include much larger numbers of reaction channels and valve modules, e.g., from about 2 to about 100 or more, preferably, from about 4 to about 50, and more preferably, from about 10 to about 50. Similarly, although illustrated with both a common inlet channel and a common outlet/detection channel, it will be appreciated that multiplexed systems, e.g., those including more than one reaction channel segment, may include a single inlet and multiple detection channels, or multiple inlets and a single detection channel, or multiple inlets and multiple detection channels.

Figure 4A:
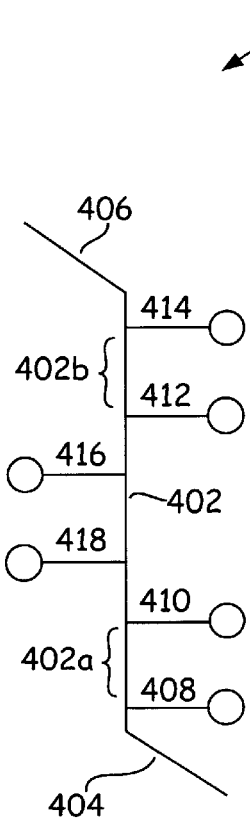
FIGS. 4A, 4B and 4C are schematic illustrations of a channel layout for a device including two pipetting elements, e.g., inlets and outlets, and valve modules for independently controlling flow into and out of those pipettors (FIG. 4A), as well as the operation of that channel structure in drawing material in (FIG. 4B) and expelling material (FIG. 4C) from the device.

As noted previously, the valve modules of the invention are optionally used in devices and systems that include both input and output functions. FIG. 4A provides a schematic illustration of a device channel layout useful in this application. As shown, the device's channel network 400 includes a main reaction channel 402. While illustrated as a single reaction channel region, this is simply for ease of description. It will be readily appreciated that greater complexity is optionally included in the reaction channel portion of the device, e.g., including side channels that intersect a given reaction channel for the addition or removal of reagents, application of electric fields, etc. The reaction channel is shown coupled at one end to a pipettor element 404 that optionally functions as an input capillary or conduit, and at the other end to another pipettor element 406 that optionally functions as an output capillary or dispensing nozzle. Two valve modules are provided coupled to the reaction channel to control both the input and output functions. In particular, the first valve module, made up of channel segments 408, 402*a* and 410, controls the drawing of fluids into the reaction channel. The second valve module made up of channel segments 412, 402*b* and 414 controls the output function. The driving pressures for each of the input and output functions are supplied through channel segments 416 and 418, respectively. As can be seen, the input driver channel is connected to the reaction channel downstream of the point at which the output driver channel is connected to the reaction channel. This simply ensures that material can be moved far enough into the device by the input driving force, that the other driving channel can act upon it, e.g., drive it to the output capillary. The structure of the pipettor elements may take a variety of different forms, including tubular capillaries having lumens or channels disposed therethrough that are attached to a body structure of a microfluidic device such that the lumens or channels provided in fluid communication with channels of that device. Alternatively, the pipettor elements may be integral portions of the body structure, e.g., shaped from the body structure's forming materials and provided with an appropriate fluid conduit disposed therethrough.

Figure 4B:
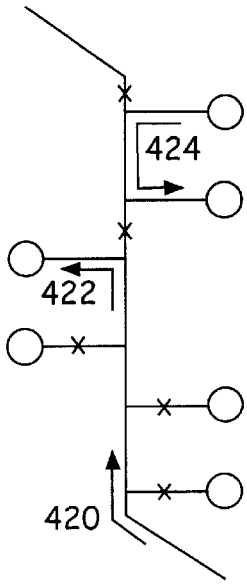
Figure 4C:
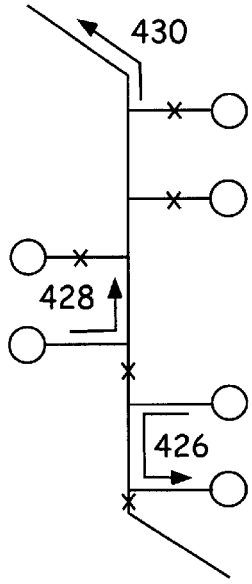

The operation of the input and output functions is illustrated in FIGS. 4B and 4C, respectively. As shown in FIG. 4A, material is drawn into the main channel 402 through input capillary 404 by applying a negative pressure to the channel through input driving channel 416 and its associated port, as indicated by arrows 420 and 422. The pressures in the input control valve module (channel segments 408 and 410) are controlled in order to ensure that the valve channels do not perturb the flow of material into the reaction channel, e.g., little or no flow is occurring in the valve module channels 408 and 410. In order to prevent material from being drawn into the reaction channel from the outlet capillary 406, the output control valve module is controlled to stop such flow, e.g., the valve is activated by applying appropriate pressures to the channel segments 412, 414 and 402*b*, as indicated by arrow 424, and as previously described herein. A lack of flow in a given channel segment is indicated by an X across the particular channel segment.

When it is desired to expel material through the output capillary (or alternatively, through another channel in place of the output capillary, e.g., into another associated channel or channel network), the negative pressure is removed from the input driving channel. At the same time, the output valve is deactivated and the input control valve is activated as shown by arrow 426, to close off the flow through the input side of the reaction channel 402 and allow flow through the output side of the reaction channel 402. The fluid is then driven out of the outlet capillary 406 by applying a positive pressure to the output driving channel 418, as indicated by arrows 428 and 430.

Alternatively, two pipettor capillaries may be used in conjunction with the valving scheme of the invention. In particular, two, three, four or more, eight or more, or twelve or more capillaries may be provided fluidly connected to a common, e.g., interconnected, channel network, to function as input capillaries or variously input and output capillaries. As used herein, the term "capillaries" generally refers to microscale fluidic components. In the case of pipettors and nozzles, such capillaries typically terminate in an open end or another receptacle, e.g., a reservoir, well, test tube, or input port for other instrumentation. In preferred aspects, such capillaries may be embodied in a tubular capillary elements that are coupled to an overall body structure that includes the channel network that includes the valve module. However, a number of other capillary, pipettor and nozzle configurations are envisioned as being useful in conjunction with the invention.

Using the valving methods and modules described herein, materials can be independently drawn into the channel network via these different pipettor elements and subjected to the same, similar or entirely different manipulations within the same channel network. In particularly preferred aspects, materials are drawn into a reaction channel and flow is slowed or arrested in order to permit incubation of those materials. During this incubation, different materials are drawn into another reaction channel, and again, flow through the reaction channel is arrested or slowed. Using the valve modules described herein, these different materials may be optionally drawn into the various reaction channels through the same or different pipettor elements.

Regulation of the driving force differentials applied through the channels of the system optionally employs a variety of different methods, depending upon the nature of the differential driving force employed. For example, where pressure differentials are employed as the driving force, then pressure and/or vacuum sources are used to supply those differentials. Alternatively, where electrokinetic forces are employed as the differential driving forces, then electrical controllers are employed to deliver the differential forces through the various channels of the device or system.

In the case of pressure-based systems, operation of the overall system including a valve module typically involves the application of a negative or positive pressure source that is operably coupled to one of the inlet side or outlet side of the overall system, e.g., reservoir 112 or 114, respectively, in FIG. 1. Pressure control also involves the use of controllable pressure sources (positive and/or negative) operably coupled to the reservoirs in the valve module, e.g., reservoirs 116 and 118, where the pressure source or sources coupled to the inlet and outlet sides of the channel system are independently controllable from each other and/or the pressure sources coupled to the valve module. Examples of systems that include multiple, independently controllable pressure sources are described in, e.g., published International Patent Application No. WO 01/63270, which is incorporated herein by reference in its entirety for all purposes. Typically, such systems employ multiple independent pressure pumps, e.g., syringe pumps that are separately operably coupled to each of the reservoirs at which more active and precise control of pressures is desired, e.g., the valve module reservoirs and at least one of the inlet and/or outlet side reservoirs. Control of flow can be accomplished either by monitoring flow while adjusting relative flow rates until the desired flow profile is achieved, or by predetermining the parameters of the control system and channel network, and operating within those parameters (see, e.g., PCT Application NO WO 01/63270, incorporated above).

Determination of the flow rate applied, e.g., to ensure that a valve is closed, may be carried out automatically, e.g., through the incorporation of optical sensors, chemical sensors, or the like within the channels of the device. Alternatively, a particular channel network may be precharacterized in terms of the necessary differential forces needed to achieve each of the flow profiles desired in an operation, e.g., opening and closing valves, etc. Such precharacterization may be based upon operational experience and data for the system being used, or it may be determined based upon the calculated expectations of the system, e.g., based upon the resistance of each of the channel segments (based upon length and cross-section) to flow under the conditions of the application, e.g., fluidic properties (viscosity) or electrical properties (conductivity).

In the case of electrical differential driving forces, control systems typically employ a number of independently regulatable voltage or current sources to apply voltage differentials through channel segments to drive material movement through those channels. Examples of controllers employing such regulatable voltage and/or current sources are described in, e.g., U.S. Pat, No. 5,800,690 (which is incorporated herein by reference in its entirety for all purposes) and are also generally commercially available, e.g., the 2100 Bioanalyzer from Agilent Technologies (Palo Alto, Calif.). Controlling voltages are supplied through electrodes that are individually contacted with the material within the reservoirs in the channel network. These electrodes are then typically coupled to separate power supplies that are controlled to apply the desired voltage differential through a given channel segment. Such control is typically accomplished through an appropriate software program script that dictates when and to what extent, voltages are applied to the various electrodes.

In the context of electrical motive force, electrical currents are applied through the various channel segments. These currents are applied in such fashion as to yield the flow profiles described above. For example, where the valve module shown in FIG. 1 is operated with an electrokinetic differential driving force, e.g., material movement is caused by a voltage differential across (or a current flow through) a channel segment. By way of example, a first voltage difference is applied across channel 102, e.g., between reservoirs 112 and 114, to drive material movement along the channel 102, electrokinetically. This will result in a different voltage at each of intersections 106 and 110. When the valve is switched off, a voltage is applied at reservoir 116 that raises the voltage at intersection 106 to equal the voltage applied at reservoir 112, eliminating any voltage differential (and current flow) between these two points. Concurrently, a voltage is applied at reservoir 118 that changes the voltage at intersection 110 to equal the voltage applied at reservoir 114, yielding net zero voltage difference between intersection 110 and reservoir 114.

Voltages may be applied in accordance with channel segments that are precharacterized to yield the desired voltage at the intersections, e.g., by knowing the resistance of each channel segment, or by empirically determining that the desired voltages are achieved, e.g., by looking for arrested material movement. Alternatively, these methods are controlled by applying current controlled methods, e.g., where one monitors current between reservoir 112 and intersection 106, and intersection 110 and reservoir 114. When that current equals zero in each case, the valve would be fully closed. Current control methods and systems for use in microfluidic systems are described in, e.g., U.S. Pat. No. 5,800,690, previously incorporated herein by reference in its entirety for all purposes.

EXAMPLES

Demonstration of Non-mechanical Valve Function

Figure 5A:
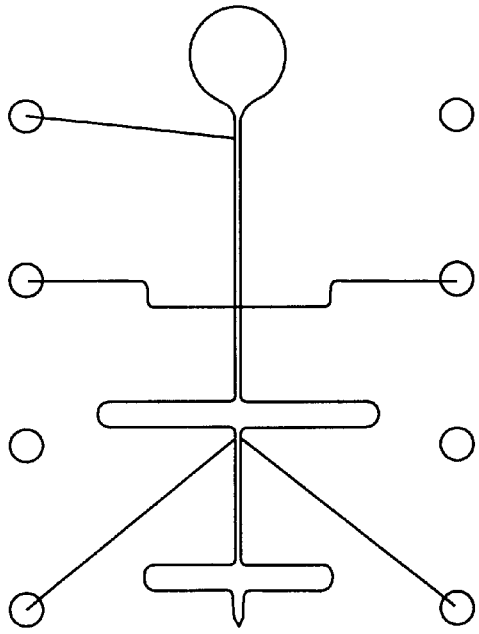
FIGS. 5A and 5B are, respectively, a CAD drawing of a channel layout and a schematic illustration of that layout that incorporates valving modules in accordance with the present invention.
Figure 5B:
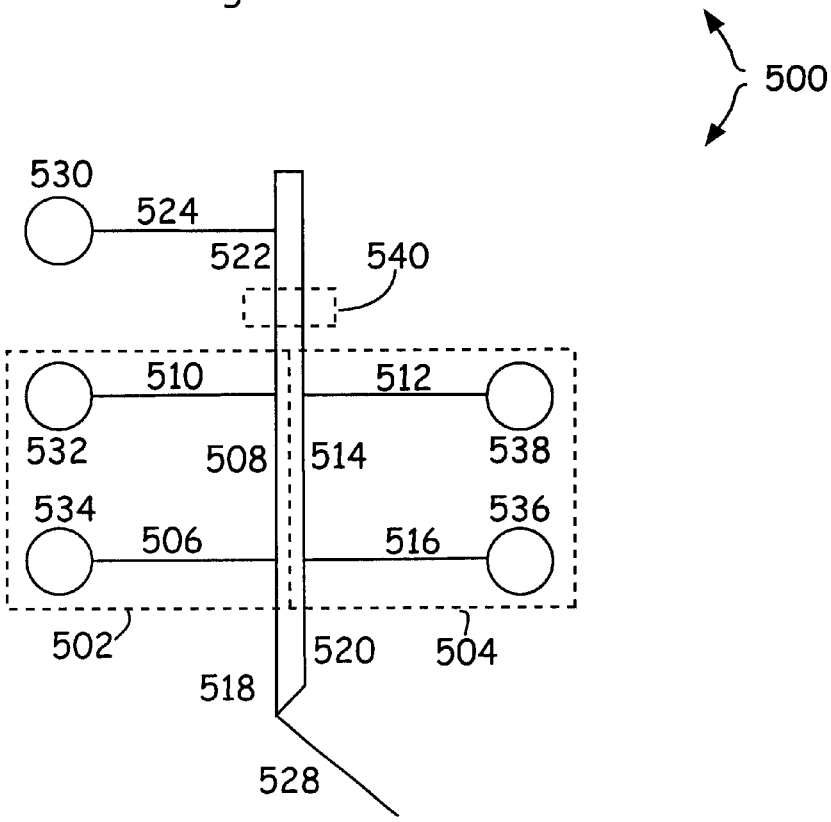

A single sipper chip was designed to demonstrate the integration of the valve module in a microfluidic channel system. FIGS. 5A and 5B shows a CAD layout and a schematic diagram of the microfluidic chip 500, respectively. The single depth chip of 8 $\mu$m consisted of two two-way on-off valve modules, 502 and 504, that operate independently to direct flow through the desired channels. The valve module 502 consists of microchannels 506, 508, and 510, and valve module 504 consists of microchannels 512, 514, and 516. The width, length, and hydrodynamic resistance of the channels are summarized in the Table 1, below. Detection of the operations in the chip is carried out at detection window 540. The channels that make up the valve module were designed with high fluidic resistances in order to improve the performance of the valve. Sample materials are brought into the channel network via an integrated capillary or pipettor element 528, (not shown in FIG. 5A, but represented by its junction point 528*a* with the channel network in the chip 500).

Simultaneous control of positive or negative pressure level at the reagent reservoirs is achieved with the use of a multiport pressure controller. The multiport control system independently sets the pressure and voltage or current at all 8 reservoirs of the device. Each reservoir is coupled to an independent peristaltic pump through a flexible tubing. Fluid flows from the sipper to reservoir 530 through channel 518 when valve module 502 is open and 504 is closed, and through channel 520 to reservoir 530 when valve module 502 is closed and 504 is open.

TABLE 1

The dimensions and resistances of the microchannels shown in FIG. 5

| Channels | Width ($\mu$m) | Length (mm) | Resistance* (g/cm$^4$s) |
|---|---|---|---|
| 518 | 31 | 20 | $2.1 \times 10^{11}$ |
| 506 | 31 | 16.1 | $1.7 \times 10^{11}$ |
| 508 | 31 | 20 | $2.1 \times 10^{11}$ |
| 510 | 31 | 14.4 | $1.52 \times 10^{10}$ |
| 522 | 66 | 9.4 | $3.9 \times 10^{10}$ |
| 524 | 66 | 13.2 | $5.4 \times 10^{10}$ |
| 526 | 66 | 23.9 | $9.8 \times 10^{10}$ |
| 512 | 31 | 14.3 | $1.5 \times 10^{11}$ |
| 514 | 31 | 20 | $2.1 \times 10^{11}$ |
| 516 | 31 | 16.1 | $1.7 \times 10^{11}$ |
| 520 | 31 | 20 | $2.1 \times 10^{11}$ |
| 528 (Sipper) | 20 (diameter) | 20 | $5.1 \times 10^{10}$ |

*Values based on a fluid viscosity of 1 cp.

Figure 6A:
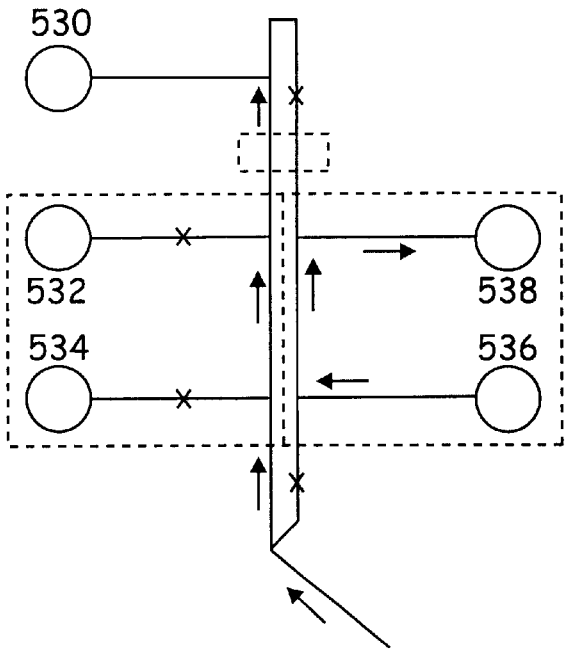
FIGS. 6A and 6B schematically illustrate the operation of the valving modules in the channel illustrated in FIG. 5A.
Figure 6B:
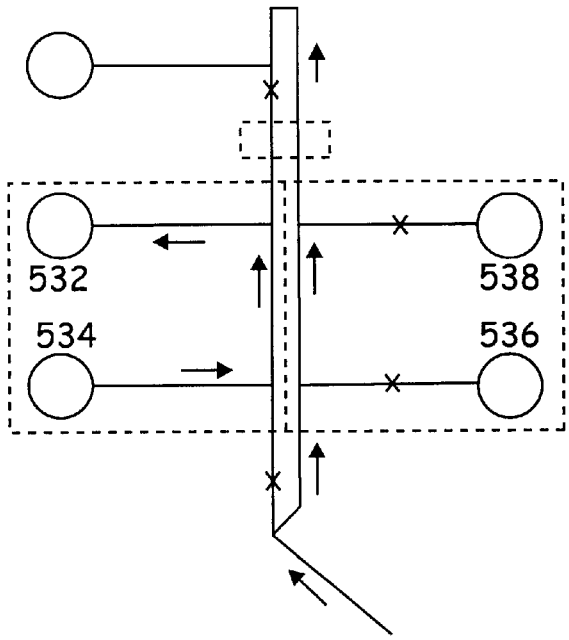

The running buffer used for the experiments on the chip was 50 mM CAPS at pH 10. Flow visualization in the microchannels was achieved by adding 1.8 $\mu$m diameter fluorescence beads to the buffer sipped from the microtiter plate. The initial setting of the pressure at each reservoir was determined from the design spreadsheet for the chip where the governing equations of the hydrodynamic flow in the channels are solved. Flow visualization was subsequently used to make any additional adjustment to the calculated pressures in order to optimize the performance of the valves To test the performance of the valve module integrated on chip, 50 mM CAPS buffer containing 1.8 $\mu$m diameter fluorescence beads is sipped through the capillary. Using a Caliper Microfludic Developer Station equipped with a multiport pressure controller, two alternating scripts were written to open and close the two valves to direct flow from the sipper to reservoir 530 through either channel 518 or channel 520. As illustrated in FIG. 6A, the valve module 502 is maintained in the open position and valve module 504 is closed by setting the reservoir pressures. Under these conditions the fluid flows from the sipper 528 to well 530 through channel 518 only while flow is prevented through channel 520. Alternatively, as shown in FIG. 6B, the flow can be directed to reservoir 530 through channel 520 when the valve module 502 is closed and 504 is open. Again, an "X" indicates stopped flow within a given channel segment. The pressure settings for these two cases are summarized in Table 2, below.

TABLE 2

The reservoir pressure values for the two cases illustrated in FIG. 6A and 6B

| Condition | P at 530 (psig) | P at 532 (psig) | P at 534 (psig) | P at 536 (psig) | P at 538 (psig) |
|---|---|---|---|---|---|
| Valve A open Valve B closed | −3.09 | −2.60 | −1.43 | 1.79 | −4.6 |
| Valve B open Valve A closed | −3.29 | −4.99 | 1.98 | −1.39 | −2.49 |

Visual observation of the operation of the system, under a microscope confirmed that the valves could be used to selectively substantially shut off flow into one channel while allowing flow in the other connected channel.

All publications and patent applications are herein incorporated by reference to the same extent as if each individual publication or patent application was specifically and individually indicated to be incorporated by reference. Although the present invention has been described in some detail by way of illustration and example for purposes of clarity and understanding, it will be apparent that certain changes and modifications may be practiced within the scope of the appended claims.

What is claimed is:

1. A method of controlling material flow in a microscale channel, comprising:

providing a first channel segment having first and second ends, a second channel segment communicating with the first channel segment at a first fluid junction, the first fluid junction being disposed between the first and second ends of the first channel segment, and a third channel segment communicating with the first channel segment at a second fluid junction, the second fluid junction being disposed between the first fluid junction and the second end of the first channel segment;

applying a differential driving force between the first and second ends of the first channel segment; and selectively applying a second differential driving force through the second channel segment that is sufficient to substantially eliminate a differential driving force between the first end of the first channel segment and the first fluid junction, and selectively applying a third differential driving force through the third channel segment sufficient to substantially eliminate a differential driving force between the second fluid junction and the second end of the first channel segment.

2. The method of claim 1, wherein the first differential driving force comprises a pressure differential applied between the first and second ends of the first channel segment.

3. The method of claim 1, wherein the first differential driving force comprises an electrical differential applied between the first and second ends of the first channel segment.

4. The method of claim 1, wherein the differential driving force comprises both a pressure differential and an electrical differential between the first and second ends of the first channel segment.

5. The method of claim 1, wherein the first differential driving force comprises a pressure differential applied through the second channel segment.

6. The method of claim 1, wherein the first differential driving force comprises an electrical differential applied through the second channel segment.

7. The method of claim 1, wherein the differential driving force comprises both a pressure differential and an electrical differential through the second channel segment.

8. The method of claim 1, wherein the first differential driving force comprises a pressure differential applied through the third channel segment.

9. The method of claim 1, wherein the first differential driving force comprises an electrical differential applied through the third channel segment.

10. The method of claim 1, wherein the differential driving force comprises both a pressure differential and an electrical differential through the third channel segment.

11. The method of claim 1, wherein the first end of the first channel segment comprises a junction with at least one other channel segment.

12. The method of claim 1, wherein the first end of the first channel segment comprises a junction with at least a first fluid reservoir.

13. The method of claim 1, wherein the second end of the first channel segment comprises an junction with at least one other channel segment.

14. The method of claim 1, wherein the second end of the first channel segment comprises a junction with at least a first fluid reservoir.

15. The method of claim 1, wherein the step of applying the first differential driving force comprises applying a positive pressure to the first end of the first channel segment.

16. The method of claim 1, wherein the step of applying the first differential driving force comprises applying a negative pressure to the second end of the first channel segment.

17. The method of claim 16, wherein the step of applying the first differential driving force further comprises applying a positive pressure to the first end of the first channel segment.

18. The method of claim 1, wherein the differential driving force between the a first end of the first channel segment and the first fluid junction is at least 90% eliminated.

19. The method of claim 1, wherein the differential driving force between the first end of the first channel segment and the first fluid junction is at least 95% eliminated.

20. The method of claim 1, wherein the differential driving force between the first end of the first channel segment and the first fluid junction is at least 99% eliminated.

21. The method of claim 1, wherein the differential driving force between the second fluid junction and the second end of the first channel segment is at least 90% eliminated.

22. The method of claim 1, wherein the differential driving force between the second fluid junction and the second end of the first channel segment is at least 95% eliminated.

23. The method of claim 1, wherein the differential driving force between the second fluid junction and the second end of the first channel segment is at least 99% eliminated.

24. A microfluidic system, comprising:

a first channel segment having first and second ends;

a second channel segment communicating with the first channel segment at a first fluid junction, the first fluid junction being disposed between the first and second ends of the first channel segment;

a third channel segment communicating with the first channel segment at a second fluid junction, the second fluid junction being disposed between the first fluid junction and the second end of the first channel segment; and a flow controller operably coupled to at least one of the first and second ends of the first channel segment and the second and third channel segments, and set to:

apply a first differential driving force between the first and second ends of the first channel segment;

selectively apply a second differential driving force to the second channel segment that is sufficient to substantially eliminate a differential driving force between the first end of the first channel segment and the first fluid junction; and selectively apply a third differential driving force through the third channel segment sufficient to substantially eliminate a differential driving force between the second fluid junction and the second end of the first channel segment.

25. The system of claim 24, wherein the first, second and third channels are disposed in a single integrated body structure.

26. The system of claim 24, wherein the flow controller comprises a pressure source operably coupled to at least one of the first and second ends of the first channel segment.

27. The system of claim 24, wherein the flow controller comprises at least first electrical power supply operably coupled to the first and second ends of the first channel segment.

28. The system of claim 24, wherein the at least one electrical power supply is operably coupled to the second and third channel segments.

29. The system of claim 24, wherein the flow controller is removably operably coupled to at least one of the first and second ends of the first channel segment.

30. The system of claim 24, further comprising a capillary element fluidly coupled to the first end of the first channel segment.

31. The system of claim 24, further comprising a capillary element fluidly coupled to the second end of the first channel segment.

32. The system of claim 24, further comprising first and second capillary elements fluidly coupled to the first channel segments, the first and second fluid junctions being disposed along the first channel segment at points between points at which the first and second capillary elements are in fluid communication with the first channel segment, at least one of the first and second capillary elements being an input pipettor.

33. The system of claim 24, further comprising an input pipettor and an output nozzle, the input pipettor being fluidly coupled to the first end of the first channel segment and the output nozzle being fluidly coupled to the second end of the first channel segment.

34. A method of sampling and dispensing materials, comprising:

providing a microfluidic device that comprises:

a first channel network comprising at least one valve module, the valve module comprising first, second and third channel segments in the channel network, the second and third channel segments intersecting the first channel segment at an inlet end and an outlet end of the first channel segment, the inlet and outlet ends of the first channel segment forming inlet and outlet sides of the valve module, respectively, and a flow controller that directs flow of fluid through the first, second and third channel segments to selectively stop flow into and out of the inlet and outlet sides of the valve module when the valve module is in a closed configuration, and allowing flow into and out of the inlet and outlet sides of the valve module when the valve module is in an open configuration;

first and second pipettor elements fluidly connected to the first channel network, wherein the first pipettor element is fluidly connected to the first channel network on an inlet side of the valve module, and the second pipettor element is fluidly coupled to the first channel network on an outlet side of the valve module;

drawing material into the channel network via the first pipettor while maintaining the valve module in the closed configuration;

converting the valve module to an open configuration; and flowing the material out of the second pipettor element.

* * * * *

UNITED STATES PATENT AND TRADEMARK OFFICE

CERTIFICATE OF CORRECTION

PATENT NO. : 6,681,788 B2
DATED : January 27, 2004
INVENTOR(S) : Parce et al.

It is certified that error appears in the above-identified patent and that said Letters Patent is hereby corrected as shown below:

Column 14,
Line 32, before "first end", please delete "a".

Signed and Sealed this

Thirteenth Day of April, 2004

JON W. DUDAS
*Acting Director of the United States Patent and Trademark Office*